US011725669B2

(12) United States Patent
Gao

(10) Patent No.: US 11,725,669 B2
(45) Date of Patent: Aug. 15, 2023

(54) WIND SHROUD AND A FAN WITH THE SAME

(71) Applicant: ZHUICHUANG TECHNOLOGY (SUZHOU) CO., LTD., Suzhou (CN)

(72) Inventor: Chunchao Gao, Suzhou (CN)

(73) Assignee: ZHUICHUANG TECHNOLOGY (SUZHOU) CO., LTD., Suzhou (CN)

( * ) Notice: Subject to any disclaimer, the term of this patent is extended or adjusted under 35 U.S.C. 154(b) by 12 days.

(21) Appl. No.: 17/349,218

(22) Filed: Jun. 16, 2021

(65) Prior Publication Data

US 2021/0396248 A1 Dec. 23, 2021

(30) Foreign Application Priority Data

Jun. 18, 2020 (CN) ..... 202010558340.1

(51) Int. Cl.

| | |
|---|---|
| ***F04D 29/42*** | (2006.01) |
| ***F04D 29/54*** | (2006.01) |
| ***F04D 29/32*** | (2006.01) |
| ***F04D 29/66*** | (2006.01) |

(52) U.S. Cl.

CPC ..... *F04D 29/545* (2013.01); *F04D 29/325* (2013.01); *F04D 29/663* (2013.01); *F04D 29/667* (2013.01)

(58) Field of Classification Search

CPC ..... F04D 29/4226; F04D 29/4253; F04D 29/545; F04D 29/547

See application file for complete search history.

(56) References Cited

U.S. PATENT DOCUMENTS

| | | | | |
|---|---|---|---|---|
| 10,641,282 | B2 * | 5/2020 | Hayamitsu | F04D 29/384 |
| 2016/0017895 | A1 | 1/2016 | Chang et al. | |
| 2016/0025109 | A1 | 1/2016 | Katsumata et al. | |

FOREIGN PATENT DOCUMENTS

| | | | |
|---|---|---|---|
| CN | 1430935 | A | 7/2003 |
| CN | 201370537 | Y | 12/2009 |
| CN | 102931795 | A | 2/2013 |
| CN | 203607936 | U | 5/2014 |
| CN | 106073631 | A | 11/2016 |
| CN | 209340173 | U * | 9/2019 |
| CN | 209340173 | U | 9/2019 |

(Continued)

*Primary Examiner* — Sabbir Hasan

(74) *Attorney, Agent, or Firm* — Nolte Lackenbach Siegel; Myron Greenspan

(57) ABSTRACT

In the application disclosed are a wind shroud, which is used in a fan with a movable impeller, and a fan with the same. The wind shroud is integrally formed and comprises a body configured to be internally hollowed in an axial direction of the body for receiving the movable impeller. The body comprises an air inlet end and an air outlet end, and the air inlet end has an inner sidewall and an outer sidewall spaced apart from each other to form a silencing cavity for buffering the vibration generated when the movable impeller is rotated, so as to reduce the noise of the fan. In a direction from the air inlet end to the air outlet end, a distance between the inner sidewall of the air inlet end and the outer sidewall of the air inlet end first gradually increases, and then gradually decreases. In the above manner, where the wind shroud of the present application is applied to a fan, the noise problem of the fan can be effectively addressed.

14 Claims, 12 Drawing Sheets

(56) References Cited

FOREIGN PATENT DOCUMENTS

| | | | |
|---|---|---|---|
| CN | 111520365 | A | 8/2020 |
| CN | 212278023 | U | 1/2021 |
| CN | 212278062 | U | 1/2021 |
| CN | 212278063 | U | 1/2021 |
| CN | 212454994 | U | 2/2021 |
| CN | 212462899 | U | 2/2021 |
| EP | 2867539 | B1 | 12/2016 |
| JP | 2014103827 | A | 6/2014 |

* cited by examiner

A

B

WIND SHROUD AND A FAN WITH THE SAME

CROSS REFERENCE

This application claims the benefits of CN application No. 202010558340.1 filed on Jun. 18, 2020, entitled "A WIND SHROUD AND A FAN WITH THE SAME", of which the entire disclosure is incorporated herein by reference.

TECHNICAL FIELD

This application relates to the technical field of vacuum cleaners, and in particular to a wind shroud and a fan with the same.

BACKGROUND

With the development of society and the continuous improvement of people's living standards, vacuum cleaners have been widely used in various households as household cleaning apparatus. A vacuum cleaner is an electrical appliance that uses a fan to generate negative air pressure in a sealed casing to suck in dust or garbage.

With the continuous advancement of fan manufacturing technology, fans of high speed, high efficiency, and high reliability have been widely used in high-end household appliances such as vacuum cleaners. However, the noise issue will be deteriorated due to the high speed and degrades the product's user experience.

Generally, the fan vibrates greatly during operation, which results in a relatively louder noise during the operation of the vacuum cleaner. Therefore, it is needed to study a wind shroud and a fan with the same.

SUMMARY

In view of the shortcomings in the above technologies, the present application provides a wind shroud and a fan with the same, which are able to effectively address the noise issue.

To solve the above technical problems, a technical solution proposed in this application is:

A wind shroud used in a fan with a movable impeller, wherein the wind shroud is integrally formed and comprises a body configured to be internally hollowed for receiving the movable impeller; wherein the body comprises an air inlet end and an air outlet end, and the air inlet end has an inner sidewall and an outer sidewall spaced apart from each other to form a silencing cavity for buffering the vibration generated when the movable impeller is rotated, so as to reduce the noise of the fan; and wherein in a direction from the air inlet end to the air outlet end, a distance between the inner sidewall of the air inlet end and the outer sidewall of the air inlet end first gradually increases, and then gradually decreases.

In an embodiment of the present application, the inner sidewall of the air inlet end comprises a first air inlet area and a second air inlet area, and the first air inlet area is distal to the air outlet end than the second air inlet area, wherein the second air inlet area is smoothly connected to the first air inlet area and an inner sidewall of the air outlet end, respectively; wherein in the direction from the air inlet end to the air outlet end, an inner diameter of the first air inlet area is formed to gradually decrease, and an inner diameter of the second air inlet area is formed to gradually increase.

In an embodiment of the present application, the outer sidewall of the air inlet end comprises a first connection area arranged with an included angle with respect to the axis of the body; and a second connection area which is respectively connected to the first connection area and the first air inlet area, and is arranged outwardly relative to the first connection area, such that the air inlet end has a trumpet-shaped tip.

In an embodiment of the present application, the first connection area is substantially in a conical shape, and the included angle is in a range of 12.5° to 22.5°.

In an embodiment of the present application, in the direction from the air inlet end to the air outlet end, the inner diameter of the air outlet end is substantially formed to gradually increase; wherein the inner sidewall of the outlet end comprises a first air outlet area and a second air outlet area, wherein the first outlet area is distal to the air inlet end than the second air outlet area, and the second air outlet area is connected to the first air outlet area and the second air inlet area, respectively; wherein in the direction from the air inlet end to the air outlet end, an inner diameter of the first air outlet area remains unchanged, an inner diameter of the second air outlet area gradually increases, and the inner diameter of the first air outlet area is greater than the inner diameter of the second air outlet area.

In an embodiment of the present application, in the direction from the air inlet end to the air outlet end, the outer diameter of the outer sidewall of the air outlet end is substantially formed to gradually increase, with a change rate gradually decreased.

In an embodiment of the present application, the outer sidewall of the air outlet end comprises a third connection area and a fourth connection area, wherein the third connection area is distal to the air inlet end than the fourth connection area and is parallel to the axis of the body, and the fourth connection area is smoothly connected to the first connection area and the third connection area, respectively; and wherein an outer diameter of an outer sidewall of the fourth connection area gradually increases, and an outer diameter of an outer sidewall of the third connection area remains unchanged and is greater than the outer diameter of the outer sidewall of the fourth connection area.

In order to solve the above technical problems, a further solution proposed in this application is:

A fan comprising a wind shroud and a movable impeller arranged within the wind shroud, wherein the wind shroud is integrally formed and comprises a body configured to be internally hollowed for receiving the movable impeller; wherein the body comprises an air inlet end and an air outlet end, and the air inlet end has an inner sidewall and an outer sidewall spaced apart from each other to form a silencing cavity for buffering the vibration generated when the movable impeller is rotated, so as to reduce the noise of the fan; and wherein in a direction from the air inlet end to the air outlet end, a distance between the inner sidewall of the air inlet end and the outer sidewall of the air inlet end first gradually increases, and then gradually decreases.

In an embodiment of the present application, the inner sidewall of the air inlet end comprises a first air inlet area and a second air inlet area, and the first air inlet area is distal to the air outlet end than the second air inlet area, wherein the second air inlet area is smoothly connected to the first air inlet area and an inner sidewall of the air outlet end, respectively; wherein in the direction from the air inlet end to the air outlet end, an inner diameter of the first air inlet area gradually decreases, and an inner diameter of the second air inlet area gradually increases; wherein the projection of the first end of the movable impeller on the inner sidewall of the air inlet end is located in the first air inlet area.

In an embodiment of the present application, in the direction from the air inlet end to the air outlet end, the inner diameter of the air outlet end is substantially formed to gradually increase; wherein the inner sidewall of the outlet end comprises a first air outlet area and a second air outlet area, wherein the first outlet area is distal to the air inlet end than the second air outlet area, and the second air outlet area is connected to the first air outlet area and the second air inlet area, respectively; wherein in the direction from the air inlet end to the air outlet end, an inner diameter of the first air outlet area remains unchanged, an inner diameter of the second air outlet area gradually increases, and the inner diameter of the first air outlet area is greater than the inner diameter of the second air outlet area; and wherein a projection of a second end of the movable impeller on the inner sidewall of the air inlet end is located in the second air inlet area.

Compared with the prior arts, the disclosure represents the following beneficial effects:

The wind shroud and the fan with the same as proposed in the application is able to optimize the airflow path and reduce the friction between the airflow and the body of the wind shroud by integrally forming the body. By spacing the inner and outer sidewalls of the air inlet end apart, a silencing cavity is formed, which is able to buffer the vibration conducted during the rotation of the movable impeller, which is able to effectively address the noise issue. In addition, the distance between the inner sidewall and the outer sidewall of the air inlet end is configured to gradually increase first, and then gradually decrease. Therefore, the wind shroud in the present application is able to further improve the noise reduction effect in the airflow acceleration area.

BRIEF DESCRIPTION OF THE DRAWINGS

The accompanying drawings with reference to the embodiments will be briefly described for the purpose of demonstrating the embodiments of the application. It is apparent that the described figures as shown are merely illustrative of some embodiments as recited in the disclosure. It should be understood by those skilled in the art that various alternatives to the figures may be appreciated, without creative work involved. Among others.

DETAILED DESCRIPTION

In order to make the objective, features, and advantages of the present application more apparent and understandable, the specific embodiments of the present application will be described in detail below with reference to the accompanying drawings. It can be understood that the specific embodiments described herein are only used to explain the application, but not to construe as the limitation to the application. In addition, it should be noted that, for the sake of description, the drawings only show parts of the structure related to the present application instead of the whole structure. It should be understood that various alternatives to the embodiments described herein may be employed by those skilled in the art without creative work involved and without departing from the spirit and scope of the invention.

The terms "comprising", "having" and any variations thereof in the present application are intended to cover non-exclusive inclusions. For example, a process, method, system, product, or device which includes a series of steps or units is not limited to the listed steps or units, but may optionally comprise unlisted steps or units, or other inherent steps or units in such a process, method, product or device.

When referring to an "embodiment" in the disclosure means that the specific features, structures, or properties described in connection with the embodiment may be included in at least one embodiment of the application. The appearance of the said term in various contexts in the description does not necessarily refer to the same embodiment, nor can it be construed as an independent or alternative embodiment mutually exclusive of other embodiments. It can be clearly or implicitly understood by those skilled in the art that the embodiment(s) described herein can be combined with other embodiment(s).

When a prior art fan is operated, a movable impeller is rotated at a high speed, generating a relatively large-amplitude vibration by the friction with the airflow, which causes a relatively loud noise thereof. In addition, the movable impeller is usually housed by a wind shroud, and there is also the friction of the air inlet end of the wind shroud with the high-speed airflow, which causes a relatively large-amplitude vibration produced by the wind shroud. Having researched and developed in the long term, the R&D personnel of the present application discovered that when the airflow enters and exits the wind shroud, the flow rate and air pressure of the airflow will vary due to the change of the inner diameter of the wind shroud. In view of the above reasons, the wind shroud itself is caused to vibrate sharply due to the various pressure of the airflow, which causes the relatively loud noise of the fan.

Figure 1:
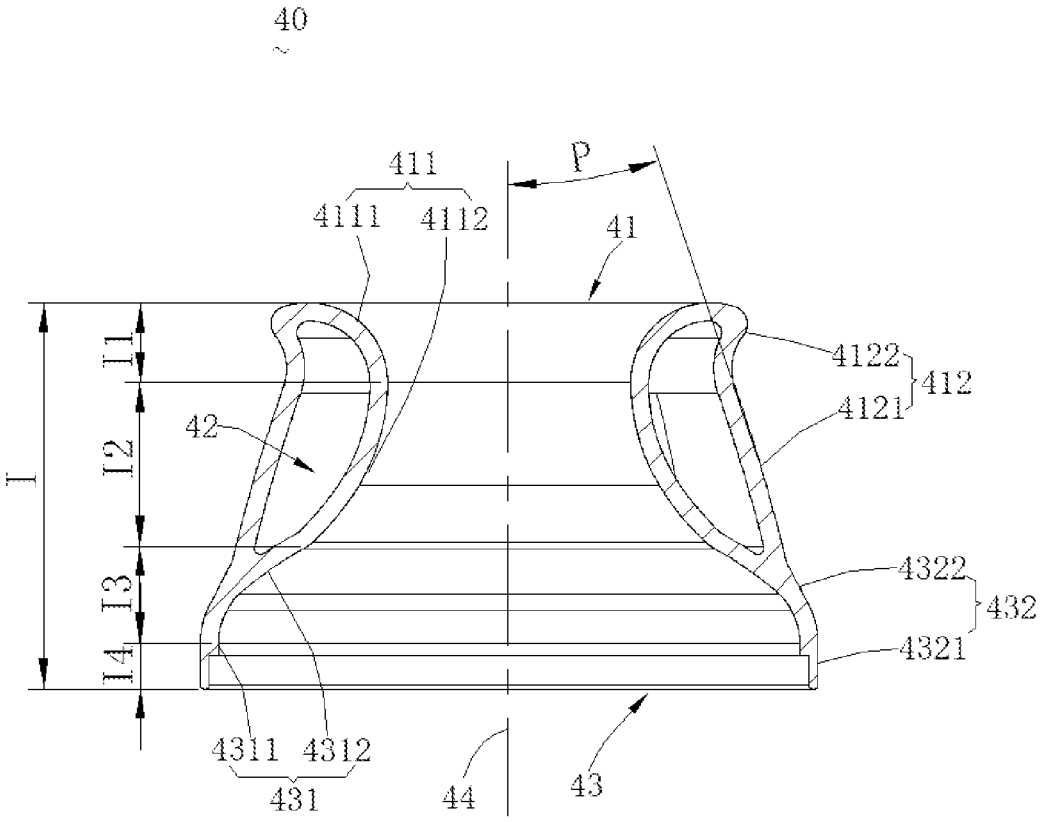
FIG. 1 is a schematic view of the cross-sectional structure of the wind shroud proposed in the present application.
Figure 2:
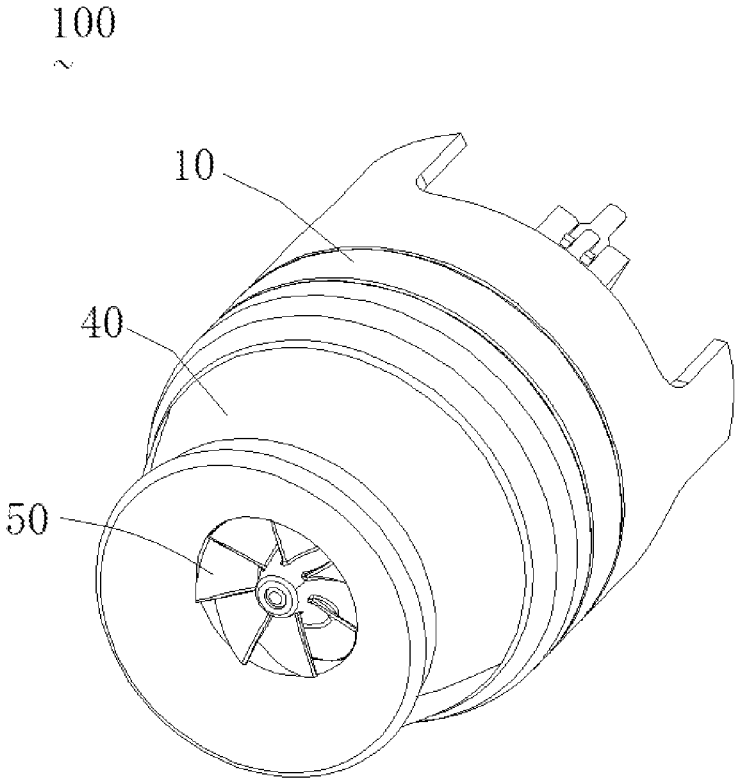
FIG. 2 is a schematic view of the overall structure of the fan proposed in the present application.

In this regard, FIGS. 1 and 2 are referenced. In FIG. 1 a wind shroud 40 as proposed in the present application is shown and in FIG. 2 a schematic view of the overall structure of the wind shroud 40 used in a fan 100 as proposed in the present application is shown. The wind shroud 40 may be used in the fan 100 having a movable impeller 50. The wind shroud 40 is integrally formed and may comprise a body configured to be internally hollowed for receiving the movable impeller 50. The body comprises an air inlet end 41 and an air outlet end 43. An inner sidewall 411 of the air inlet end 41 and an outer sidewall 412 of the air inlet end 41 are spaced apart from each other to form a silencing cavity 42 for buffering the vibration generated when the movable impeller 50 is rotated, so as to reduce the noise of the fan 100. In the direction from the air inlet end 41 to the air outlet end 43, the distance between the inner sidewall 411 of the air inlet end 41 and the outer sidewall 412 of the air inlet end 41 first gradually increases, and then gradually decreases.

With this arrangement, the wind shroud 40 in the present application is integrally formed, which may reduce the friction between the airflow and the wind shroud 40. Because of the silencing cavity 42, the vibration transmitted by means of the rotation of the movable impeller 50 may be buffered, such that the noise issue of the fan 100 may be reduced. In addition, the wind shroud 40 in the present application is further arranged to allow the distance between the inner sidewall 411 and the outer sidewall 412 of the air inlet end 41 to first gradually increase, and then gradually decrease. Therefore, when the airflow passes through the wind shroud 40, there is formed in the wind shroud 40 an area which will convergently accelerate the airflow, and the silencing cavity 42 has a maximum space in the said area, while the pressure of the airflow on the said area is relatively low, such that the noise reduction effect is improved. In the wind shroud 40 in the present application, therefore, the noise reduction effect is further improved in the airflow acceleration area.

Specifically referring to FIG. 1, in an embodiment, the inner sidewall 411 of the air inlet end 41 may comprise a first air inlet area 4111 and a second air inlet area 4112. The first air inlet area 4111, as compared to the second air inlet area 4112, is distal to the air outlet end 43. The second air inlet area 4112 is smoothly connected to the first air inlet area 4111 and an inner sidewall 431 of the air outlet end 43, respectively. As a result, the airflow consecutively passes through the first air inlet area 4111 and the second air inlet area 4112, which can reduce losses and improve the working efficiency of the fan 100.

Further, in the direction from the air inlet end 41 to the air outlet end 43, the inner diameter of the first air inlet area 4111 gradually decreases, and the inner diameter of the second air inlet area 4112 gradually increases. That is, in the direction from the air inlet end 41 to the air outlet end 43, the cavity wall of the axially hollow cavity of the body tends to first gradually decrease and then gradually increase. Therefore, the first air inlet area 4111 of the air shroud 40 herein is able to first convergently pressurize the airflow, and the gradually increased inner diameter of the second air inlet area 4112 then is able to adjust the airflow, thereby reducing the disturbance of the suctioned airflow, increasing the airflow rate and stabilizing the airflow pressure.

Furthermore, the outer sidewall 412 of the air inlet end 41 may comprise a first connection area 4121 and a second connection area 4122 which is respectively connected to the first connection area 4121 and the first air inlet area 4111 and is arranged outwardly relative to the first connection area 4121, such that the air inlet end 41 has a trumpet-shaped tip, so as to allow the airflow to gently enter the air inlet end 41 through its tip, thus realizing the purpose of buffering and noise reduction.

It is considered that an oversized included angle will lead to an oversized distance between the inner sidewall 411 of the air inlet end 41 and the outer sidewall 412 of the air inlet end 41, resulting in a week structural strength, and an undersized included angle will lead to an undersized distance between the inner sidewall 411 of the air inlet end 41 and the outer sidewall 412 of the air inlet end 41, resulting in a relatively small silencing cavity 42, which fails to achieve the preferable effect of vibration isolation and noise reduction. Accordingly, in an embodiment, the first connection area 4121 is substantially in a conical shape and is arranged with an included angle in respect to the axial direction of the body, wherein the included angle P is of an acute angle in a range of 12.5° to 22.5°.

Continually referring to FIG. 1, in an embodiment, the axial distance between the air inlet end 41 and the air outlet end 43 is defined as the length l of the body, wherein a ratio of a projection length l1 of the first air inlet area 4111 on the axis 44 to the length l of the body ranges from 6/32 to 7/32 and preferably is 6.5/32. As a result, the wind shroud 40 represents a favorable pressure reduction effect and is able to effectively prevent backflow of the air in the wind shroud 40.

A ratio of a projection length l2 of the second air inlet area 4112 on the axis 44 to the body length l ranges from 13/32 to 14/32 and preferably is 13.5/32. As a result, the wind shroud 40 represents a satisfactory pressure diffusion effect, such that the kinetic energy can be transferred into the static pressure, which will improve the pressure resistance of the wind shroud 40 and reduce air venting loss.

A ratio of the sum of the projection lengths of the first air inlet area 4111 and the second air inlet area 4112 on the axis 44 to the body length l ranges from 19.5/32 to 20.5/32 and preferably is 20/32. Therefore, the air outlet end 43 of the wind shroud has sufficient space to guide and adjust the airflow, thereby optimizing the structure of the wind shroud 40.

Continually referring to FIG. 1, in an embodiment, the outer sidewall 432 of the air outlet end 43 may comprise a third connection area 4321 and a fourth connection area 4322. The third connection area 4321 is distal to the air inlet end 41 as compared to the fourth connection area 4322 and is parallel to the axis 44 of the body. The fourth connection area 4322 is smoothly connected to the first connection area 4121 and the third connection area 4321, respectively. In the direction from the air inlet end 41 to the air outlet end 43, the outer diameter of the outer sidewall 432 of the air outlet end 43 is substantially arranged to gradually increase. To be specific, the outer diameter of the fourth connection area 4322 gradually increases, and the outer diameter of the third connection area 4321 remains unchanged.

The inner sidewall 431 of the air outlet end 43 may comprise a first air outlet area 4311 and a second air outlet area 4312, wherein the first air outlet area 4311 is distal to the air inlet end 41 as compared to the second air outlet area 4312 and is parallel to the axial direction of the body. The second air outlet area 4312 is smoothly connected to the first air outlet area 4311 and the second air inlet area 4112, respectively. In the direction from the air inlet end 41 to the air outlet end 43, the inner diameter of the inner sidewall 431 of the air outlet end 43 is substantially arranged to gradually increase, with the change rate of the inner diameter gradually decreased until reaching 0.

To be specific, the second air outlet area 4312 is used for the pressure diffusion of the airflow, while the first air outlet area 4311 is used for the pressure stabilization of the airflow. Therefore, the inner diameter of the first air outlet area 4311 remains unchanged (i.e., the change rate is 0), while the inner diameter of the second air outlet area 4312 gradually increases. And the first air outlet area is arranged to be parallel to the axis 44 of the body.

That is to say, the third connection area 4321 and the first air outlet area 4311 constitute the air outlet of the air outlet 43. The air outlet is a circular opening coaxially arranged with the body and is the largest diameter of the air outlet 43. The maximum diameter of the air end 43 is larger than the maximum diameter of the air inlet 41.

Specifically, the sum of the length of the first air inlet area 4111 in the axial direction, the length of the second air inlet area 4112 in the axial direction, the length of the first air outlet area 4311 in the axial direction, and the length of the second air outlet area 4312 in the axial direction is equal to the length of the body.

A ratio of a length l4 of the first air outlet area 4311 in the axial direction to the length l of the body ranges from 3.5/32 to 4.5/32 and preferably is 4/32, such that the airflow can be effectively adjusted.

The ratio of the length l3 of the second air outlet area 4312 in the axial direction to the length l of the body ranges from 7.5/32 to 8.5/32 and preferably is 8/32. As a result, the airflow outflowing from the second air inlet area 4112 can be continually diffused, such that the air volume demand can still be met in the event that the rotation rate of the movable impeller 50 does not increase, while this will to a certain extent prevent the increased rotation rate of the movable impeller 50 from incurring further noise.

Specifically, the body is substantially in the shape of a hollow, truncated cone with the smaller air inlet end 41 and the greater air outlet end 43. The outer sidewall of the truncated cone is constituted of the outer sidewall 412 of the air inlet end 41 and the outer sidewall 432 of the air outlet end 43. The inner sidewall of the truncated cone is constituted of the inner sidewall 411 of the air inlet end 41 and the inner sidewall 431 of the air outlet end 43, while the inner sidewall of the truncated cone is of the cavity wall of the hollow cavity of the body.

Further, the silencing cavity 42 is a closed cavity circumferentially arranged on the outer periphery of the hollow cavity of the body and is integrally formed. The body is of a plastic member. In the event that the silencing cavity 42 is integrally molded, the molding process of the body may include: blowing high-pressure air upon injection molding, that is, using a air-assisted molding process.

Further, in order to improve the noise reduction performance of the silencing cavity 42, the silencing cavity 42 may be filled with a noise reduction material (not shown), which may be selected from any of various noise reduction materials, such as sound insulation felt and sound absorbing cotton. Therefore, the noise reduction performance can be further improved, leading to a merit of the favorable noise reduction effect. In addition, the inner sidewall 411 of the air inlet end 41 and the inner sidewall 431 of the air outlet end 43 may be further coated with a noise reduction coating to further reduce the noise of the wind shroud 40.

In order to have a better noise reduction performance, furthermore, the silencing cavity 42 may be configured as a vacuum cavity. Since the sound propagation requires a medium and there is no medium in the vacuum, the noise can be effectively blocked under the vacuum condition.

It should be understood that the wind shroud in the present application may be used in various application scenarios, which will be exemplarily elaborated below.

With reference to FIG. 2, the wind shroud 40 in the present application may be used in the fan 100. In this regard, the fan 100 comprises a wind shroud 40, which may be those as described herein, and a movable impeller 50 arranged within the wind shroud 40. The silencing cavity 42 may extend along the axial direction of the movable impeller 50 to surround the movable impeller 50 in the entire circumferential direction, so as to maximumly isolate the vibration transmitted by means of the rotation of the movable impeller 50.

Figure 3:
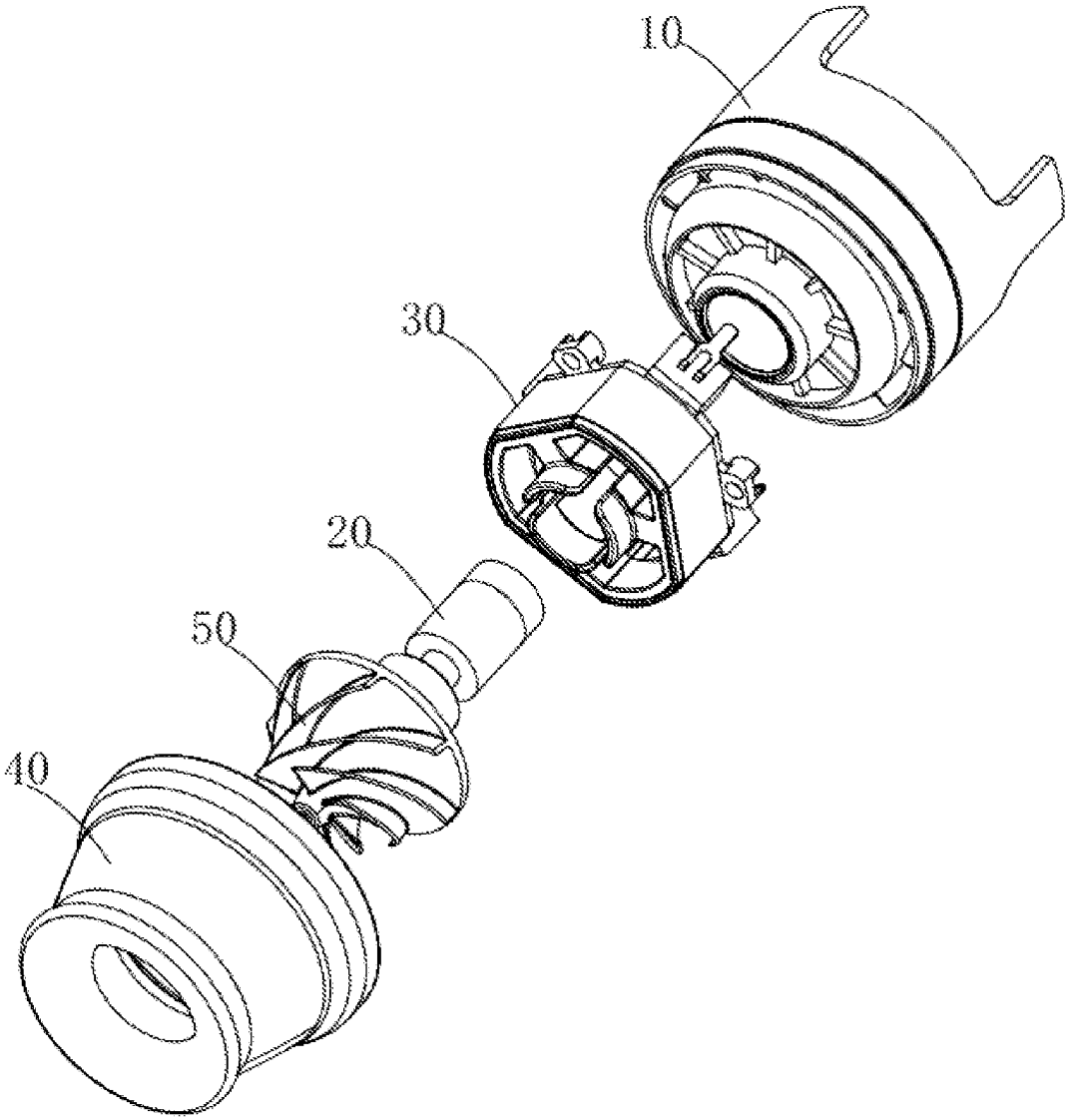
FIG. 3 is a schematic view of the exploded structure of the fan in FIG. 2.
Figure 4:
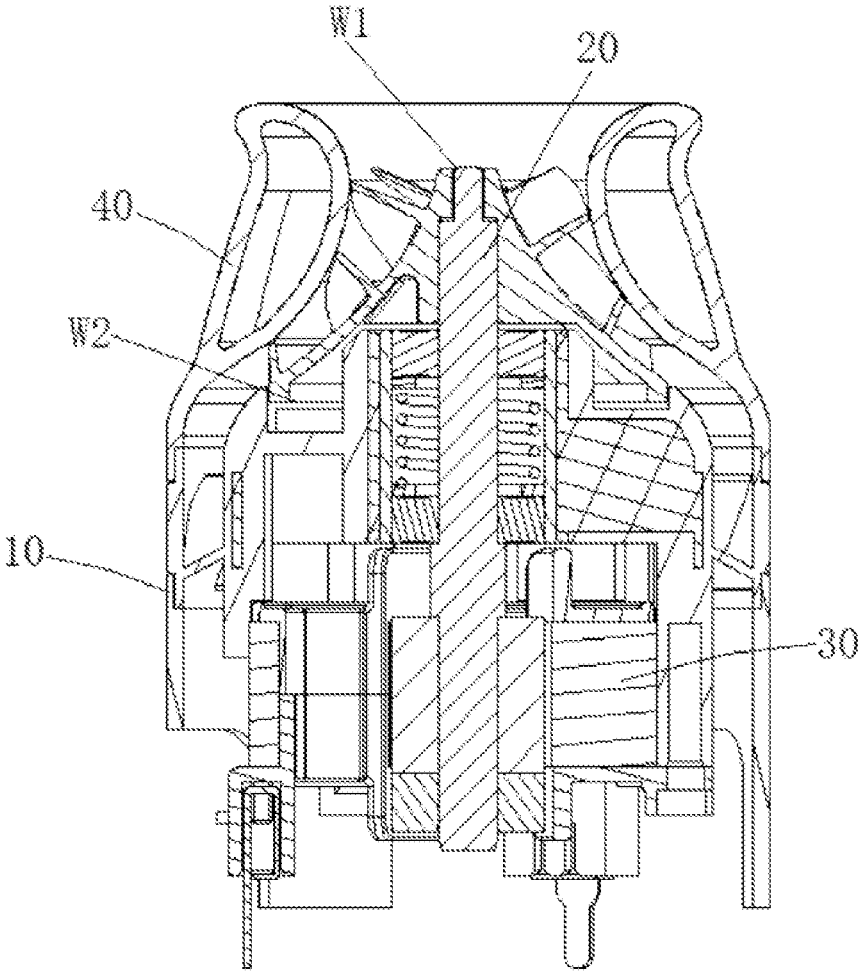
FIG. 4 is a schematic view of the cross-sectional structure of the fan in FIG. 2.

Specifically, referring to FIGS. 1-2 and FIGS. 3-4, FIG. 3 is a schematically exploded view of the structure of the fan 100 in FIG. 2, and FIG. 4 is a schematically cross-sectional structure view of the fan 100 in FIG. 2. In this regard, a first end W1 of the movable impeller 50 is lower than the tip of the air inlet end 41 of the wind shroud 40, and blades of the movable impeller 50 are as close as possible to, but not in contact with the inner sidewall 411 of the air inlet end 41. There are small gaps between the blades of the movable impeller 50 and the cavity wall of the hollow cavity of the body, with a size of the gap in a range of 0.05 to 0.5 mm, so as to avoid unwanted scraping between the blades of the movable impeller 50 and the cavity wall of the hollow cavity of the body.

Specifically, the projection of the first end W1 of the movable impeller 50 on the inner sidewall 411 of the air inlet end 41 is located in the first air inlet area 4111. Therefore, during the high-speed rotation of the movable impeller 50, it can be ensured that the airflow can pass through the first air inlet area 4111 and the second air inlet area 4112 consecutively, thereby increasing the airflow rate and reducing the disturbance of the airflow.

Furthermore, the projection of the second end W2 of the moving impeller 50 on the inner sidewall 431 of the air outlet end 43 is located in the second air outlet area 4312. Therefore, during the high-speed rotation of the movable impeller 50, it can be ensured that the airflow can pass through the second air outlet area 4312 and the first air outlet area 4311 consecutively. The airflow can be diffused and then stabilized in the air outlet end 43, and finally, flow out of the wind shroud 40.

Figure 13:
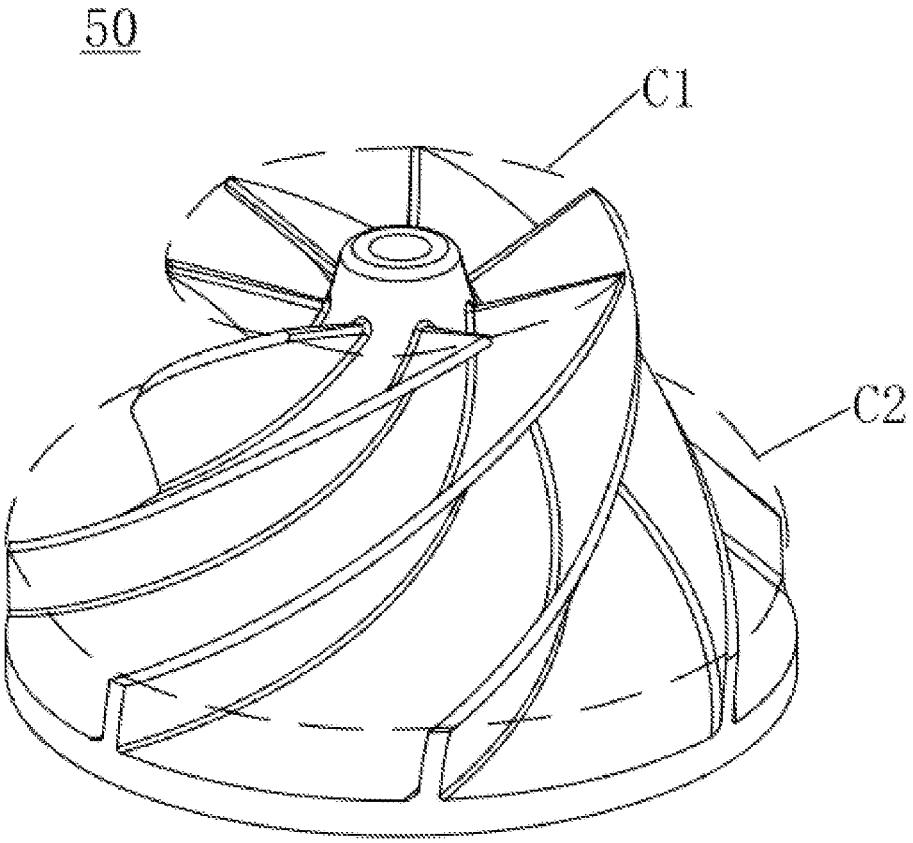
FIG. 13 is a schematically structural view of the movable impeller in FIG. 3.

Specifically, the movable impeller 50 is of a mixed-flow movable impeller, comprising a movable impeller base and a plurality of the blades formed on an outer wall of the movable impeller base. The movable impeller base is generally in a cone shape, with the cone surface to be curved. Referring to FIG. 13 in connection with 14, the movable impeller base has a narrow end and a wide end. The edges of the plurality of blades at the narrow end are located in the same circle C1 with a diameter A1, and the edges of the plurality of blades at the wide end are located in the same circle C2 with a diameter A2, wherein the ratio of A1 to A2 ranges from 0.35 to 0.75.

It is understandable that the fan 100 may also comprise an electric motor that drives the movable impeller 50 to rotate, referring to FIG. 2 and FIG. 3 that shows a structural exploded view of the fan 100 in FIG. 2. In this regard, the electric motor may comprise a housing structure 10 connected to the wind shroud 40, a rotor assembly 20 and a stator assembly 30 arranged in the housing structure 10, wherein the stator assembly 30 is arranged around the periphery of the rotor assembly 20, and the rotor assembly 20 is connected to the movable impeller 50 which constitutes the load of the electric motor.

Figure 5:
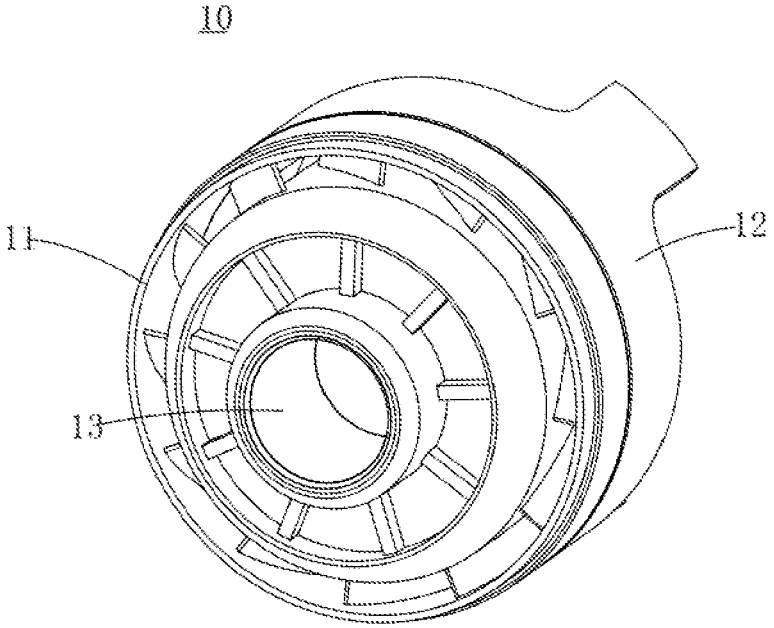
FIG. 5 is a schematic view of the housing structure in FIG. 2.
Figure 6:
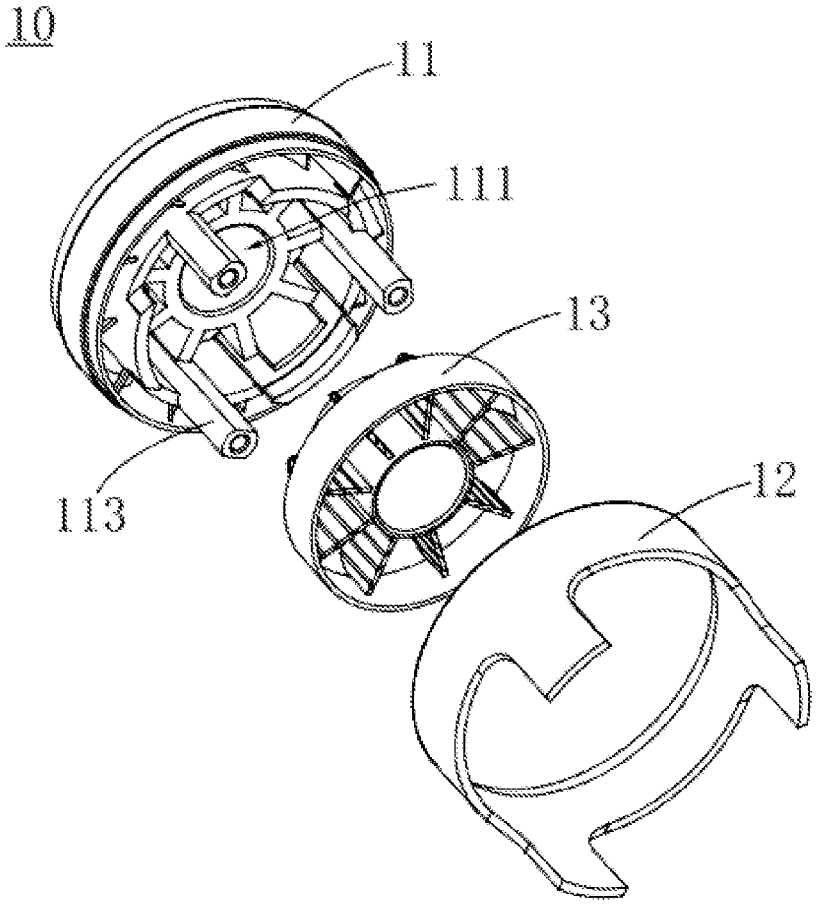
FIG. 6 is a schematically exploded view of the housing structure in FIG. 5.
Figure 7:
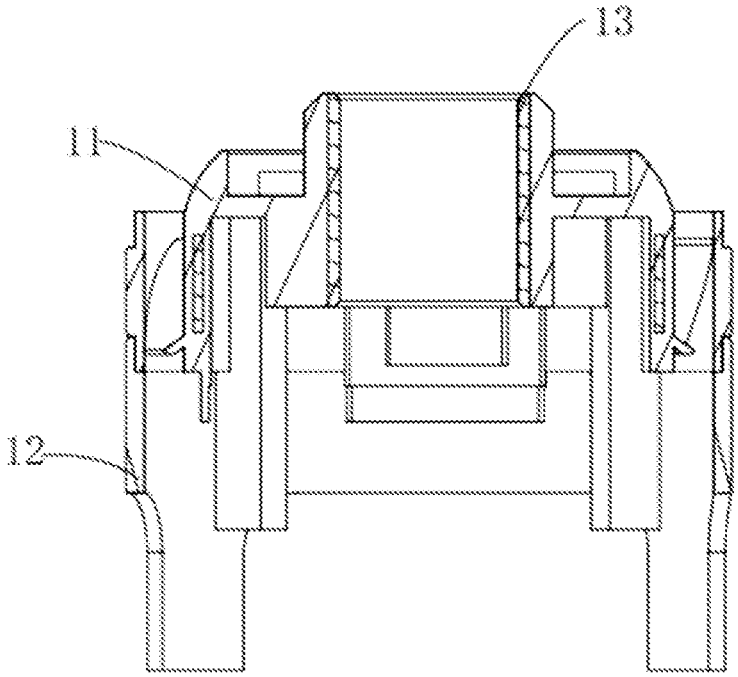
FIG. 7 is a schematically cross-sectional view of the housing structure in FIG. 5.

In an embodiment, referring to FIGS. 5 to 7, the housing structure 10 may comprise a base shell 11 and an auxiliary sleeve 12. The base shell 11 is fixedly connected to a bearing bracket 13 and a fixed impeller 112, which are arranged from inside out around the base shell 11 in the direction of its diameter. The fixed impeller 112 is arranged around the outer periphery of the bearing bracket 13, and the bearing bracket 13 is used to support a bearing unit 22 of the rotor assembly 20. By means of fixed connection of the base shell 11, the bearing bracket 13, and the fixed impeller 112 as an integrated part, therefore, the components can be reduced and it brings about the advantages of convenient installation and stable and reliable connection. The auxiliary sleeve 12 is fastened to one end of the base shell 11 by an adhesive. The base shell 11 and the auxiliary sleeve 12 can also be integrally formed. The auxiliary sleeve 12 is used to assist in fixing the drive circuit board (not shown). The base shell 11 is also provided with a plurality of bolt hole columns 113, through which the stator assembly 30 is detachably arranged in the base shell 11.

Figure 8:
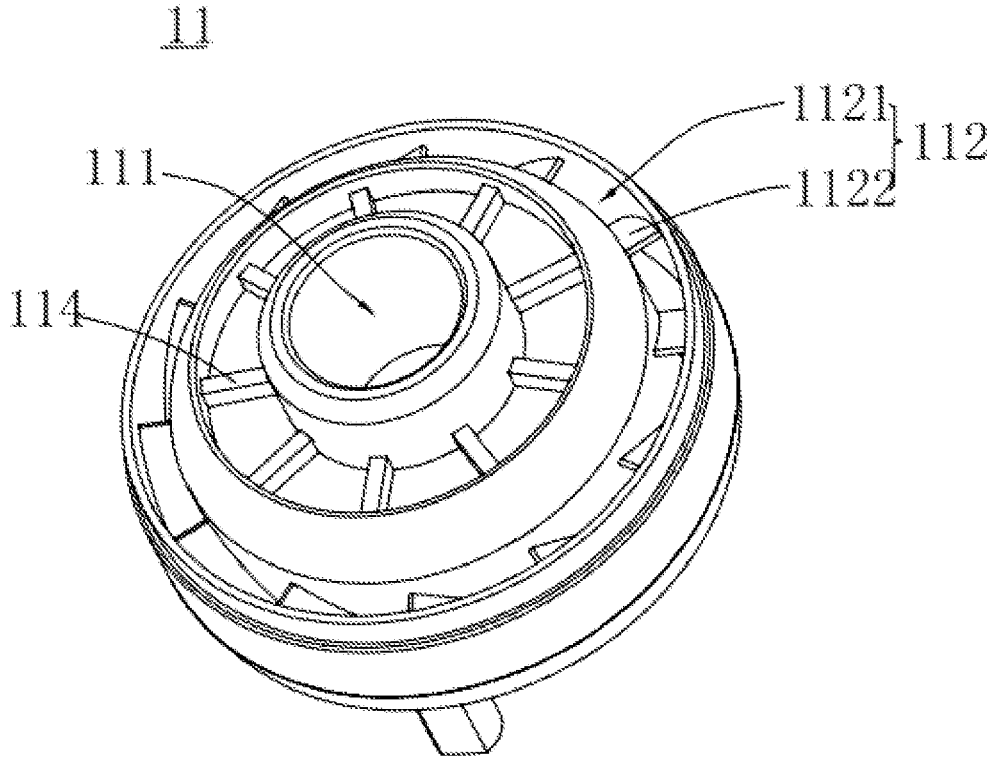
FIG. 8 is a schematically structural view of the base shell in FIG. 5.

Considering that the rotor assembly 20 will generate significant heat during operation which will damage the bearing unit 22 and that a plastic material has a heat dissipation performance not as good as that of a metal material, referring to FIGS. 7 and 8, the bearing bracket 13 which will support the bearing unit 22 is thus configured as a metal piece, while the base shell 11 is configured as a plastic piece, with the bearing bracket 13 arranged inside the base shell 11. In the present application, by configuring the bearing bracket 13 as a metal piece, it is also beneficial to improve the installation accuracy of the bearing unit 22 and the bearing bracket 13, which brings about the advantages of accurate installation and stable and reliable connection.

Taking into consideration of the convenience of processing, referring to FIG. 7, the base shell 11 and the bearing bracket 13 are fixedly connected to each other by injection molding, by which the bearing bracket 13 is completely embedded in the base shell 11.

Figure 9:
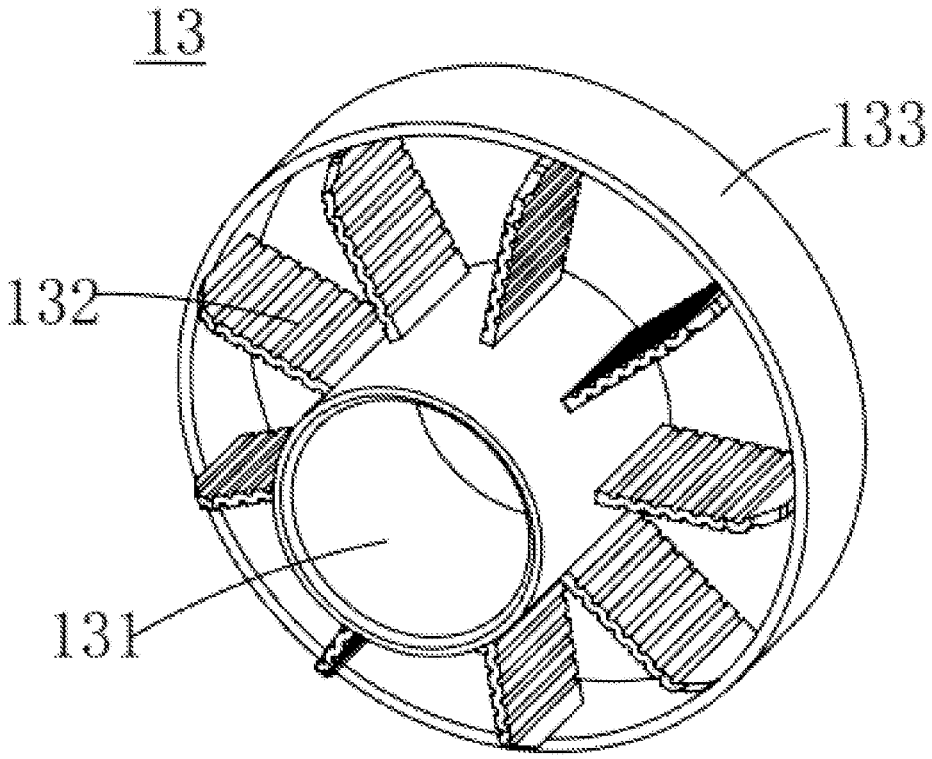
FIG. 9 is a schematically structural view of the bearing bracket in FIG. 5.

In an embodiment, referring to FIGS. 7 and 9, the base shell 11 is provided with a central hole 111 in the axial direction thereof, and the bearing bracket 13 may comprise a first circular column 131 located in the central hole 111, a second circular column 133 coaxially arranged and embedded in the base shell 11, and a plurality of fins 132 fixedly arranged between the first circular column 131 and the second circular column 133. The fitting relationship between the first circular column 131 and the central hole 111 is an interference fit, which has the advantage of a stable and reliable connection. The fins 132 are embedded in the base shell 11, with one end thereof fixed to the outer circumferential wall of the first circular column 131, and the opposite end fixed to the inner circumferential wall of the second circular column 133. The fins 132 are distributed at equal intervals along the circumferential direction of the first circular column 131 or the second circular column 133. The fins 132 have surfaces provided with a plurality of circular arc concave faces for increasing the surface area thereof to facilitate heat dissipation.

Further referring to FIG. 8, the base shell 11 is also formed with reinforcing ribs 114 distributed at equal intervals along the circumferential direction of the central hole 111 on the outer periphery of the central hole 111, wherein the ribs 114 are arranged to cover fins 132, and the number of the reinforcing ribs 114 is the same as the number of the fins 132, preferably in a range of 5 to 11. The reinforcing ribs 114 are able to reinforce the structural strength of the base shell 11.

In an embodiment, continually referring to FIG. 8, the fixed impeller 112 comprises a circular groove 1121 formed in the base shell 11, a plurality of fixed blades 1122 distributed in the circular groove 1121, wherein the circular groove 1121 and the central hole 111 is arranged coaxially, and the fixed blades 1122 may be distributed at equal intervals along the circumferential direction of the annular groove 1121, and may be used to adjust the airflow.

Figure 10:
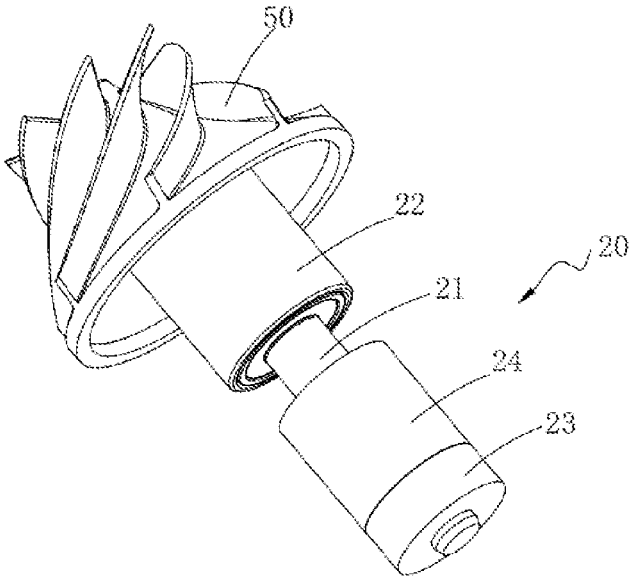
FIG. 10 is a schematic view showing the positional relationship between the rotor assembly and the movable impeller in the present application.
Figure 11:
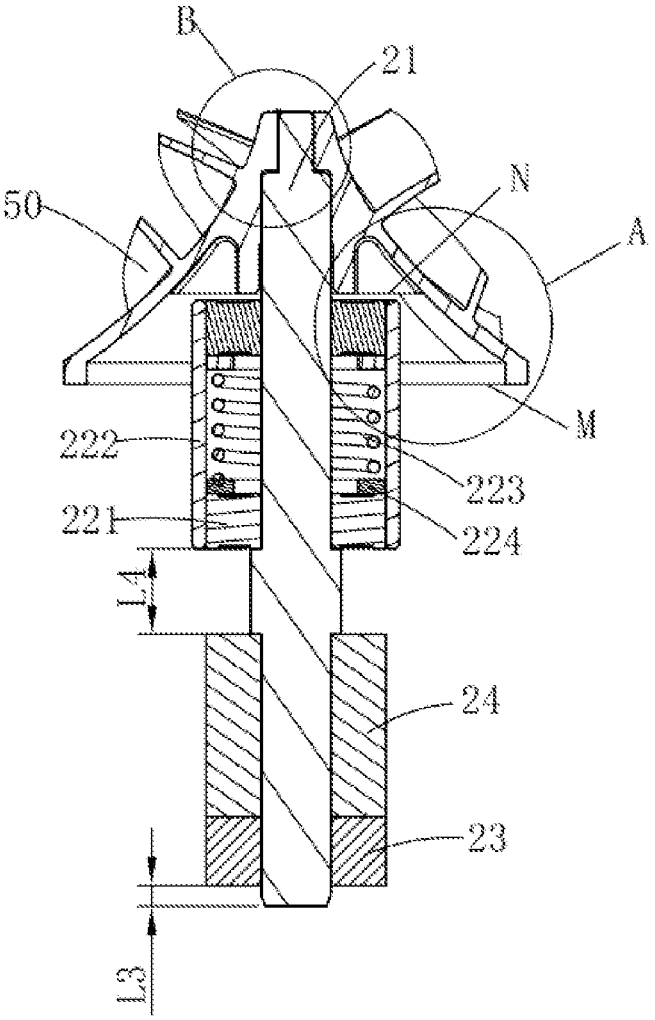
FIG. 11 is a schematic view of the cross-sectional structure according to FIG. 10.
Figure 12:
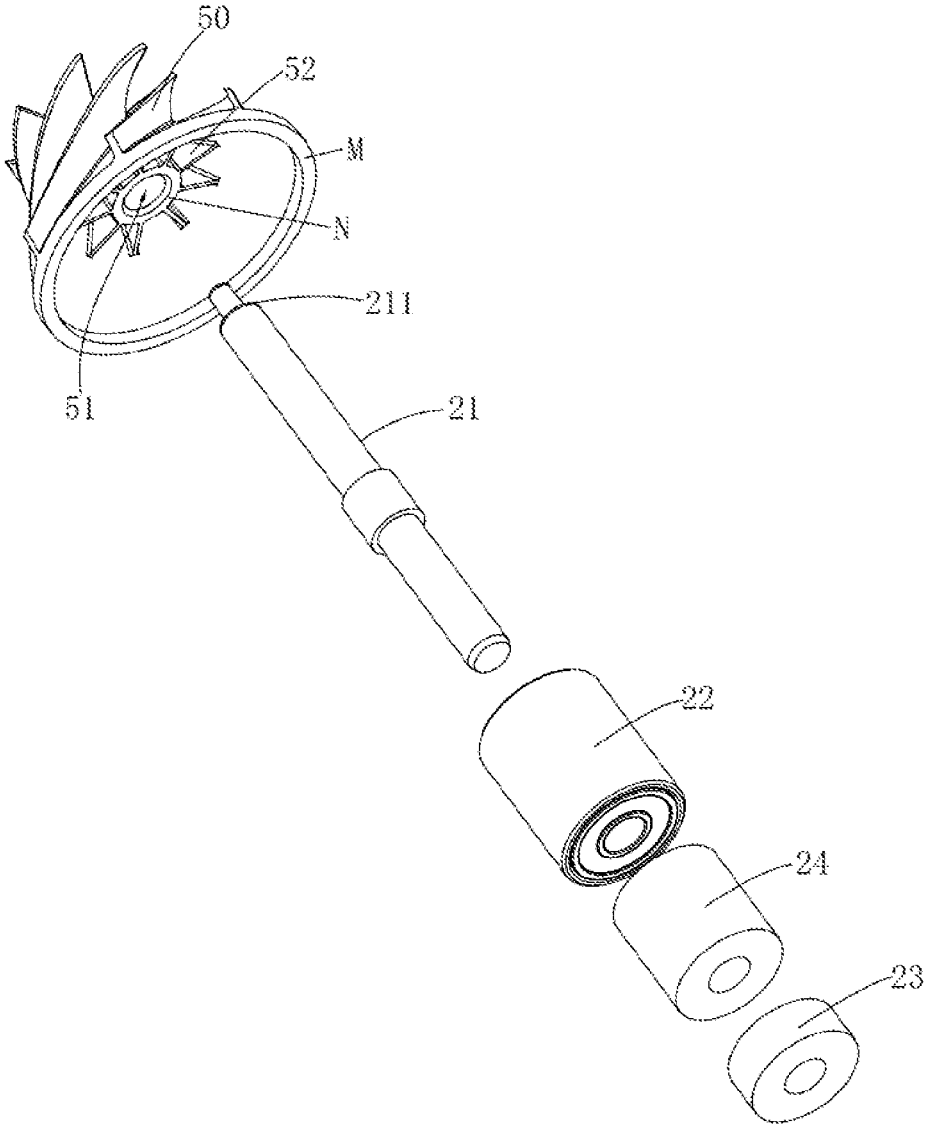
FIG. 12 is a schematically exploded view according to FIG. 10.

In an embodiment, referring to FIGS. 10 to 12, the rotor assembly 20 comprises a rotatable shaft 21, a bearing unit 22, a magnet 24, and a balance ring 23, wherein the bearing unit 22, the magnet 24, and the balance ring 23 are arranged in sequence along the axial direction of the rotatable shaft 21. The rotatable shaft 21 is formed with a shaft shoulder portion for axial positioning of the bearing unit 22 and the magnet 24. The magnet 24 has an end abutting against the shaft shoulder portion, and an opposite end abutting against the balance ring 23. The magnet 24 and the movable impeller 50 are respectively located at opposite sides of the bearing unit 22. The magnet 24 and the rotatable shaft 21 are connected to each other by an adhesive. The bearing unit 22 is arranged in a column hole of the first circular column 131 and is in interference fit with the first circular column 131. Referring to FIG. 11, the balance ring 23 is configured to limit the radial movement of the rotatable shaft 21 to reduce the centrifugal runout caused by the dynamic unbalance during rotation of the rotatable shaft 21, and the balance ring 23 is interference fitted with the rotatable shaft 21. The rotatable shaft 21 in its axial direction has one end fastened to the movable impeller 50, and another end extending out of a balance ring 23, with a distance L3 extending out the balance ring 23, wherein $L3 \geq 1.5$ mm. It is arranged for a purpose of facilitating the disassembly and assembly of the balance ring 23, which has the advantage of convenient installation.

Figure 14:
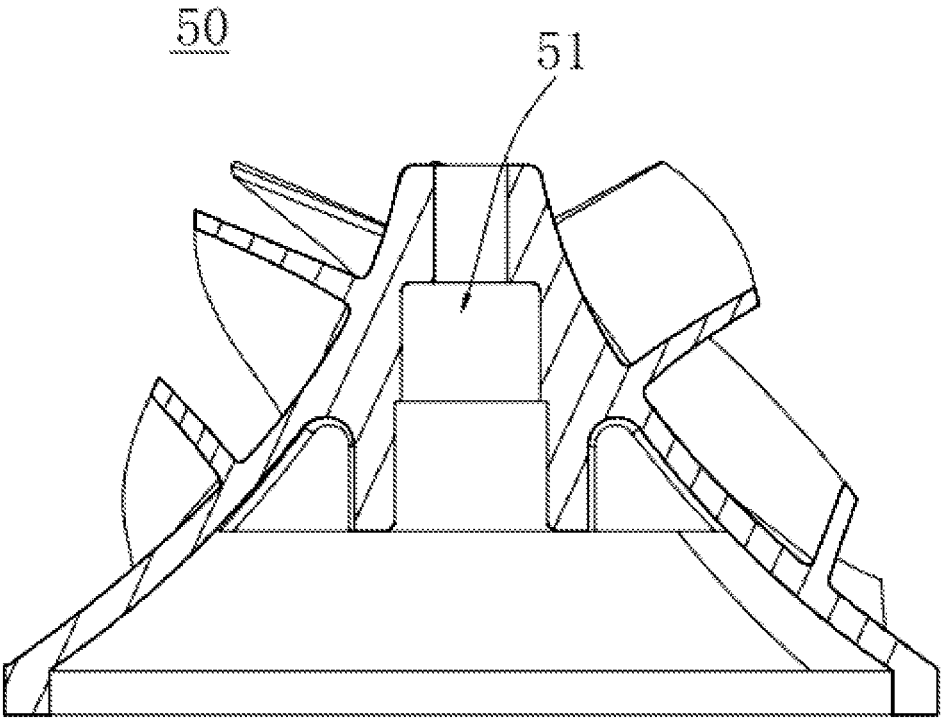
FIG. 14 is a schematically cross-sectional view of the movable impeller in FIG. 13.

Referring to FIG. 12 in connection with FIG. 14, in the present application, the movable impeller 50 is formed with a socket 51 for inserting the rotatable shaft 21. The socket 51 is a multi-stepped hole, and one end of the rotatable shaft 21 is provided with a shaft shoulder 211 for fitting with the stepped hole to form different diameters, and cylindrical sections of different diameters are fitted with the socket 51 to form an interference fit area section and a clearance fit area section suitable for an adhesive connection. By means of the above manners, the socket 51 can be in both an interference fit and a clearance fit with the rotatable shaft 21 wherein there may be the adhesive connection in the clearance fit section between the shaft 21 and the socket 51, which can be well applicable to the high-speed rotation of the rotatable shaft 21 with the advantages of simple structure and stable and reliable connection.

In an embodiment, referring to FIG. 14, the socket 51 is a three-stepped hole with a first hole portion, a second hole portion, and a third hole portion that are arranged coaxially and incrementally increase in diameter, and the first hole portion is arranged distally to the electric motor. There is a clearance fit between the first hole portion and the rotatable shaft 21, an interference fit between the second hole portion and the rotatable shaft 21, and a clearance fit between the third hole portion and the rotatable shaft 21. The arrangement of the above-mentioned three-stepped holes can form one interference fit section and two clearance fit sections, so as to facilitate the installation and fitting of the socket 51 and the rotatable shaft 21.

Specifically, referring to FIG. 12, one end of the rotatable shaft 21 is provided with a shaft shoulder 211 which allows the one end of the rotatable shaft 21 formed with a small-diameter journal for clearance fit with the first hole. Therefore, the fit relationship between the rotatable shaft 21 and the socket 51 can be satisfied by providing such a shaft shoulder 211, which has the advantages of simple structure and convenient machining.

Figure 16:
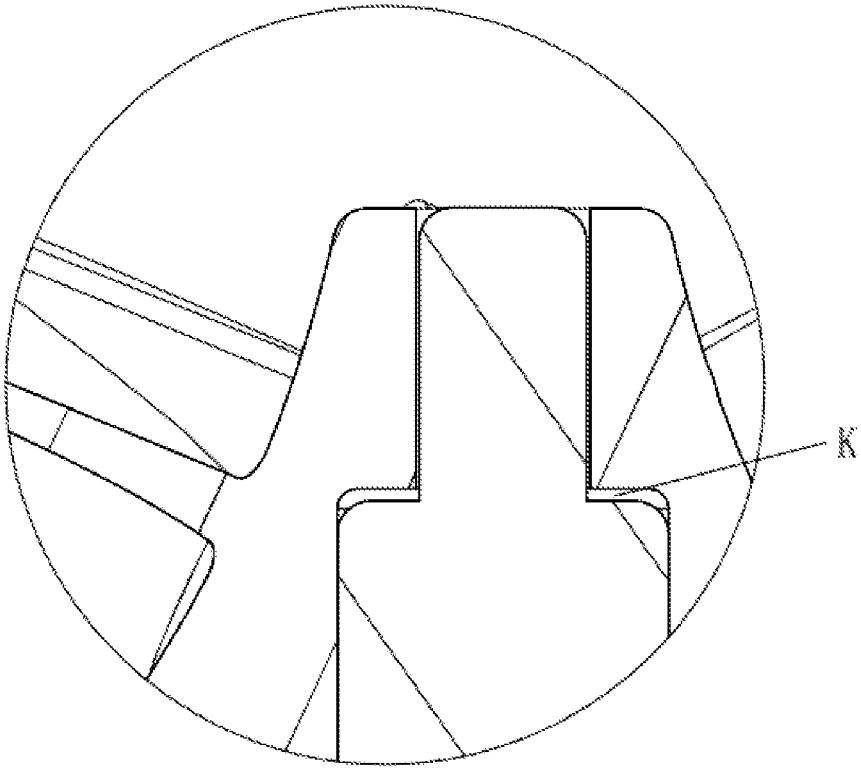
FIG. 16 is a schematically enlarged view of area B in FIG. 11.

Further, referring to FIG. 11 in connection with FIG. 16, there is a hole shoulder formed at a junction portion between the first hole and the second hole. Formed between the hole shoulder and the shaft shoulder 211 in the axial direction there is a gap K for receiving an adhesive. The value of the gap K may be in a range of 0.2 mm<K<0.5 mm. The value of the above-mentioned gap K may not be set too small to receive the adhesive. The value may not be set too great, and otherwise, the overall structure of the electric motor and the movable impeller 50 may be bulk.

Further referring to FIG. 12, a lower middle portion of the movable impeller 50 is formed with a cavity, in which a plurality of ribs 52 are arranged and are distributed on the outer periphery of the socket 51 at equal intervals along the circumferential direction of the socket 51. The ribs 52 are flush with an end face N of the socket 51 in the cavity, and the ribs 52 can effectively enhance the structural strength of the movable impeller 50.

In an embodiment, referring to FIG. 11, the bearing unit 22 partially is inserted into the movable impeller 50 in the axial direction of the rotatable shaft 21, and the movable impeller 50 is not in contact with the bearing unit 22. The movable impeller 50 is rotated with the rotation of the rotatable shaft 21. The bearing unit 22 is fastened in the first circular column 131. If the movable impeller 50 is in contact with the bearing unit 22, the normal operation of the moving impeller 50 will be affected. By inserting the end of the bearing unit 22 proximal to the movable impeller 50 into the movable impeller 50, therefore, the length of the rotor assembly in the axial direction is shortened, the manufacturing cost is reduced, and the weight of the fan 100 is reduced.

Figure 15:
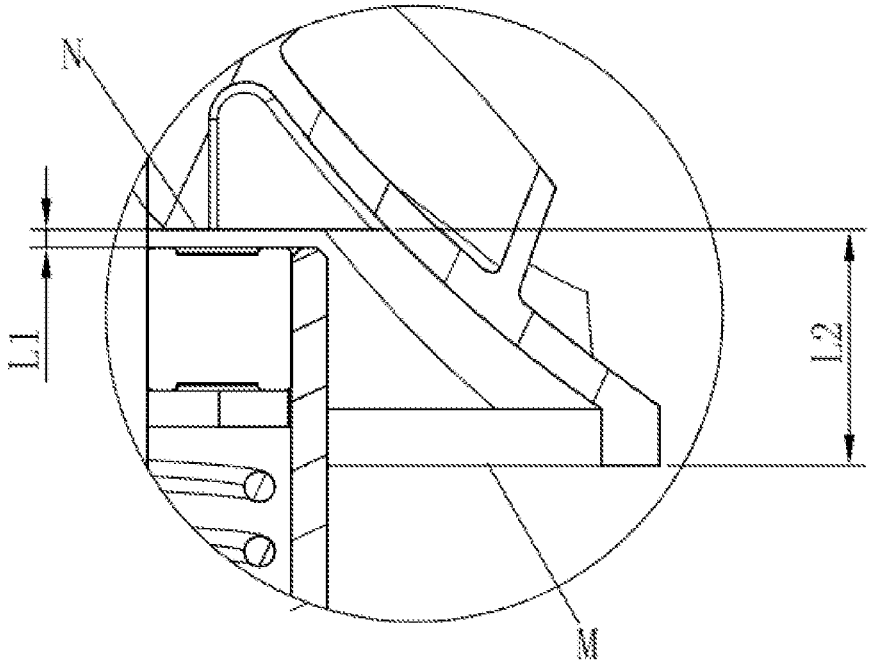
FIG. 15 is a schematically enlarged view of area A in FIG. 11.

Further referring to FIG. 11 in connection with FIG. 15, the end face of the socket of the movable impeller 50 proximal to the insertion end of the bearing unit 22 is defined as the socket end face N, and the end face of an outer hub of the movable impeller 50 proximal to the insertion end of the bearing unit 22 is defined as the outer hub end face M, wherein the distance between the socket end face N and the end face of the insertion end of the bearing unit 22 is L1, and the distance between the socket end face N and the outer hub end face M is L2, with a ratio of L1 to L2 in a range of 0.07 to 0.18, for a purpose of maximumly saving space. Specifically, L1 may be valued as small as possible, such that the socket end face N may be as close as possible to, but not in contact with the end face of the insertion end of the bearing unit 22. During operation, the socket end face N is rotated at a high speed, and the end face of the insertion end of the bearing unit 22 stays static.

Furthermore, the bearing unit 22 comprises a sleeve 222 and a pair of bearings 221 fastened to two axial ends of the sleeve 222, respectively, and the rotatable shaft 21 is rotatably arranged in the sleeve 222 by means of the bearings 221. The bearing 221 is a deep groove ball bearing. The bearing 221 is located in a sleeve cavity of the sleeve 222. The sleeve 222 is pressed into the first circular column 131 and is in an interference fit with the first toroidal column 131. There is an interference connection between an outer ring of the bearing 221 and a sleeve wall of the sleeve 222, and there is also an interference connection between an inner ring and the rotatable shaft 21.

Further, the bearing unit 22 further comprises a spring 223 and a washer 224 located in the sleeve cavity of the sleeve 222, wherein the washer 224 abuts against the outer ring of the bearing 221 under the spring force of the spring 223, for a purpose of keeping rolling elements of the bearing 221 always located in a raceway of the bearing 221.

Figure 17:
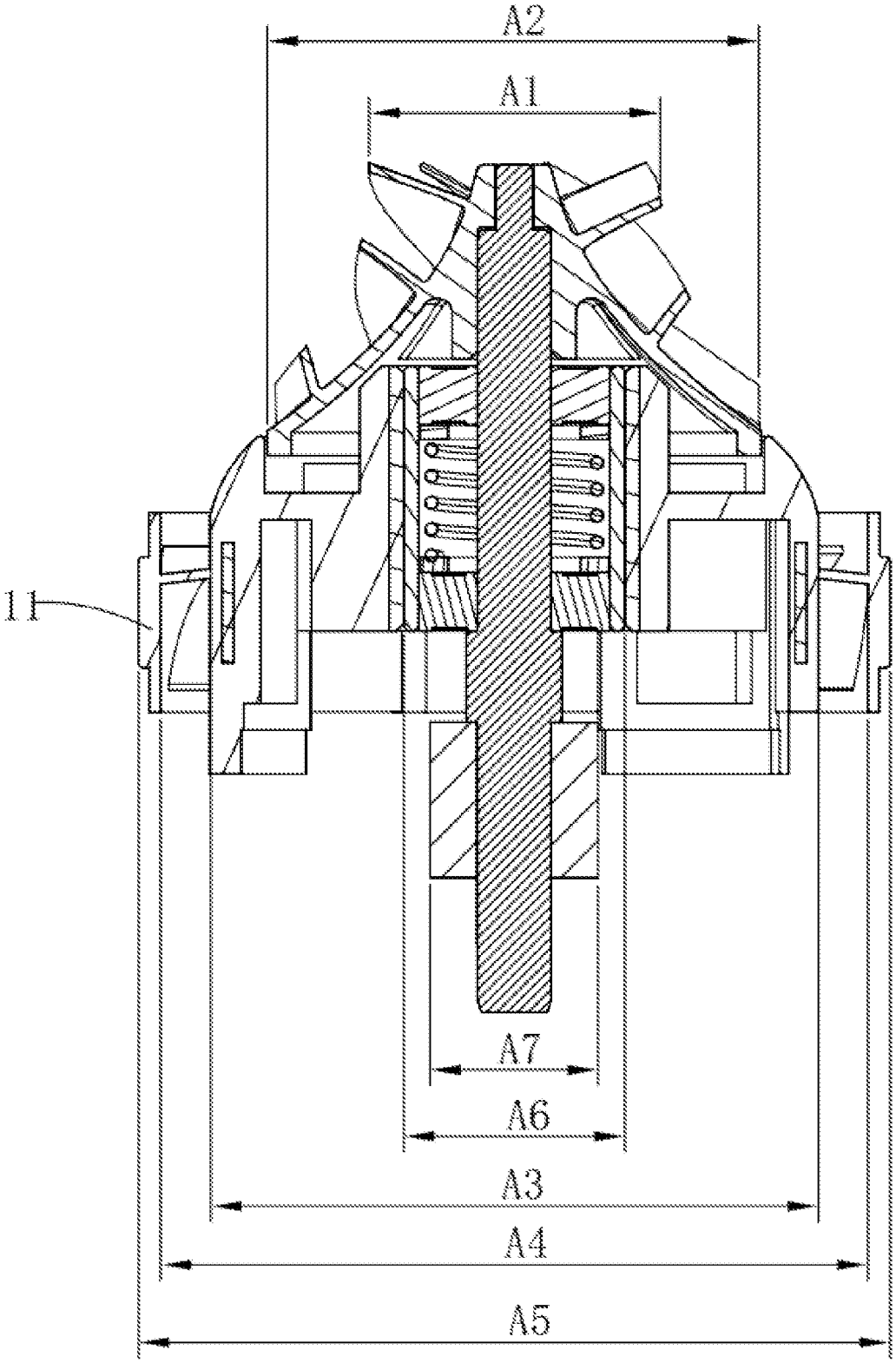
FIG. 17 is a schematically cross-sectional view of the movable impeller and the base shell in the present application.

Further referring to FIG. 17, the inner ring diameter of an annular groove 1121 is A3, the outer ring diameter is A4, and the outer ring diameter of the base shell 11 is A5 which is the maximum outer diameter of the housing structure 10, A1, A2, A3, A4, and A5 satisfy the relationship: A1<A2<A3<A4<A5. The inner diameter of the first circular column 131 of the bearing bracket 13 is A6, and the diameter of the outer ring of the magnet 24 is A7, wherein A7<A6 and A6<A1. The value of A6 is in a range of 12 to 18 mm, for fitting with a bearing of appropriate size 221. The value of A7 is in a range of 10 to 15 mm, allowing a compact appearance of a lightweight electric motor.

Further referring to FIG. 11, the axial distance between the bearing unit 22 and the magnet 24 is L4 which is the length of the shaft shoulder portion of the rotatable shaft 21 in the axial direction, where L1<L4, with a ratio value of L1 to L4 in a range of 0.05 to 0.2, which presents a favorable transmission effect. The value of L1 may be in a range of 0.2 to 3 mm, and specifically may be selected from any of 0.5 mm, 1 mm, 1.5 mm, 2 mm, and 2.5 mm. The value of L4 may be in a range of 3 to 10 mm, and specifically may be selected from any of 4 mm, 5 mm, 6 mm, 7 mm, 8 mm, and 9 mm. When ensuring a compact structure, it makes the stator assembly 30 more reliable for long-term operation. As a result, the electric motor has a compact and more reliable structure.

Figure 18:
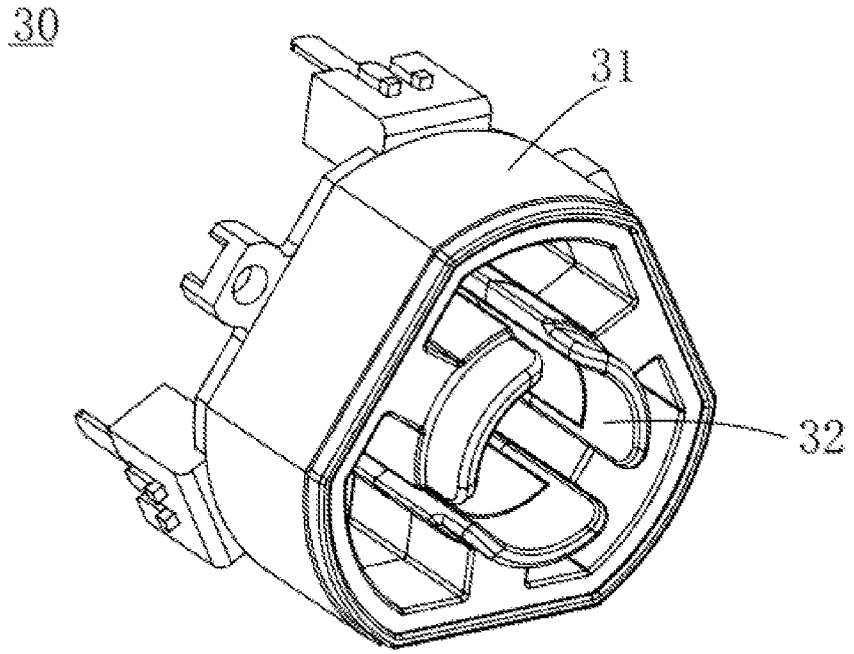
FIG. 18 is a schematically structural view of the stator assembly in FIG. 3.
Figure 19:
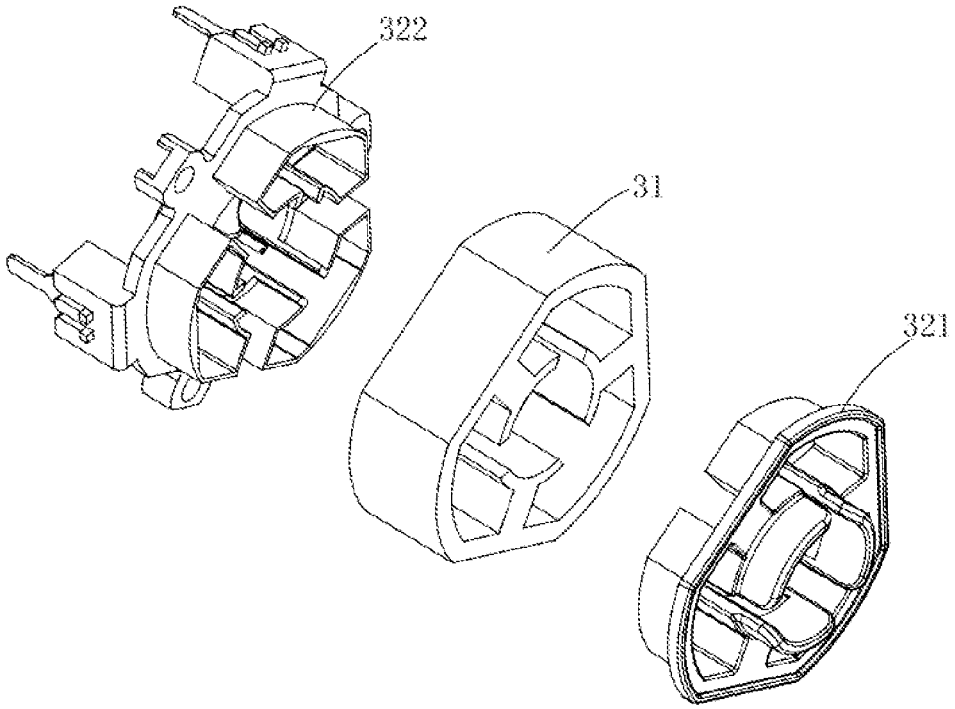
FIG. 19 is a schematically exploded view of the stator assembly in FIG. 18.
Figure 20:
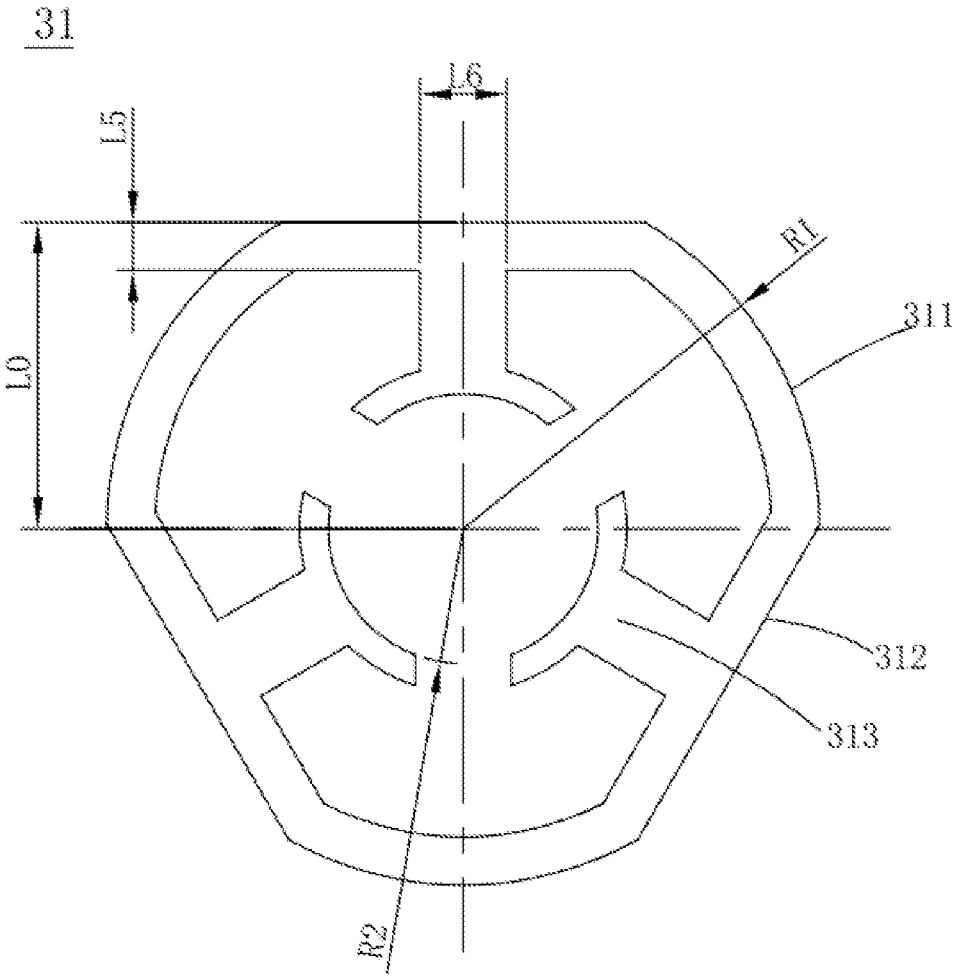
FIG. 20 is a schematic view of the stator core in FIG. 19.

In an embodiment, referring to FIGS. 18 to 20, the stator assembly 30 comprises a stator core 31, a frame 32 supporting the stator core 31, and a winding located in a winding groove. The stator core 31 comprises an annular yoke portion, a plurality of stator teeth 313. The annular yoke portion is in a shape of an irregular circle in the radial direction and comprises a plurality of first yoke sub-portions 311 and second yoke sub-portions 312 connected to each other consecutively. The first yoke sub-portions 311 and the second yoke sub-portion 312 have different shapes, and the plurality of the first yoke sub-portions 311 and the plurality of the second yoke sub-portions 312 have a common central axis. The stator teeth 313 are arranged in the annular yoke, extending in the radial directions of the annular yoke, and are distributed at equal intervals along the circumferential direction of the annular yoke. Winding slots are formed between two adjacent stator teeth 313. The tips of the stator teeth 313 are in the shape of an arc, and a gap is reserved between the tips of adjacent stator teeth 313 for receiving the winding wires to be wound on the stator teeth 313.

Further referring to FIG. 20, the tips of the stator teeth 313 together form a core inner hole, which is the inner hole of the stator core 31. The first yoke sub-portions 311 have a central axis. The radius of the core inner hole is defined as R2, the maximum radius between the outer circumferential wall of the first yoke sub-portions 311 and the above-mentioned central axis is defined as R1, and the minimum radius between the central axis and the outer wall of the second yoke sub-portions 312 is defined as L0, wherein L0, R1, and R2 meet: $0.7 \leq L0/R1 \leq 0.98$, and $0.3 \leq R2/R1 \leq 0.45$. Preferably, the value of L0/R1 may be specifically selected from any of 0.75, 0.80, 0.85, 0.90, and 0.95, and the value of R2/R1 may be specifically selected from any of 0.35, 0.38, 0.40, and 0.42. Where L0/R1 and R2/R1 are taken as above values, the fan may represent high efficiency and lightweight effect. In this application, by defining the structure of the stator core, and by defining the value ranges of the ratios among the radius R2 of the inner hole of the core, the maximum radius R1 between the outer circumferential walls of the first yoke sub-portions 311 and the above-mentioned central axis, and the minimum distance L0 between the central axis and the outer walls of the second sub-portions 312, it can reduce the volume and the weight of the electric motor under a certain output power of the electric motor, so as to achieve the purpose of high efficiency and lightweight effect of the electric motor.

Further referring to FIG. 20, the minimum yoke thickness of the annular yoke portion is defined as L5, and the tooth thickness of the stator teeth 313 is defined as L6; wherein L5 and L6 meet: $1.6 \leq L6/L5 \leq 2.2$. The values of L6/L5 may be specifically selected from any of 1.7, 1.8, 1.9, 2.0, and 2.1. Where L6/L5 is taken as the above values, the stator core 31 has ideally structural strength and also represents a preferable capacity for receiving winding wires. Specifically, assuming that the sum of the numbers of the first yoke sub-portions 311 and the second yoke sub-portions 312 is 6, and each yoke sub-portion has a thickness, the thicknesses of the six yoke sub-portions are H1, H2, H3, H4, H5, and H6, respectively, among which the smallest one is defined as L5.

Furthermore, where the thickness of each sub-yoke of the annular yoke portion is not the same, the smallest thickness of the yoke sub-portions is L5, or, where the thickness of each yoke sub-portion of the annular yoke portion is the same, each yoke sub-portion has a thickness greater than or equal to L5. The thickness of each yoke sub-portion of the annular yoke part can be determined according to the actual use conditions.

Further referring to FIG. 20, the first yoke sub-portions 311 are in a shape of an arc in the radial direction of the annular yoke, and the second yoke sub-portions 312 are in a linear form or in a form of angled line in the radial direction of the annular yoke, wherein the first yoke sub-portions 311 and the second yoke sub-portions 312 are distributed alternately, and the stator teeth 313 are disposed on the second yoke sub-portions 312. Preferably, the stator teeth 313 are located at the midpoint of the second yoke sub-portions 312. Where the included angles between the stator teeth 313 and the second yoke sub-portions 312 are right angles, the second yoke sub-portions 312 are in linear form in the radial direction of the annular yoke. Where the included angles between the stator teeth 313 and the second yoke sub-portions 312 are obtuse angles, the second yoke sub-portions 312 are in the form of the angled line in the radial direction of the annular yoke (not shown). It is not recommended to set the angle between the stator teeth 313 and the second yoke sub-portions 312 to be an acute angle, which will reduce the volume of the winding slot of the stator core, which is not suitable for arranging the winding.

Furthermore, the stator core 31 is formed of n spliced sub-cores of the same shape and size, where n is the same as the number of the stator teeth 313. The stator core 31 is formed by laminating at least two pieces in the thickness direction thereof. The pieces are made by pressing amorphous powder or soft magnetic material and then heat treatment thereof.

Further, referring to FIG. 19, the frame 32 is arranged in a discrete form, and comprises a first frame body 321 snapped on one end of the stator core 31 and a second frame body 322 snapped on an opposite end of the stator core 31. Specifically, the frame 32 is cooperated with the stator core 31 and covers the winding groove of the stator core 31 to prevent the winding wire from directly contacting with the stator core 31, and which leads to enhanced insulation and prevents the stator core 31 from cutting a wire sheath of the winding. In addition, the frame 32 also facilitates winding of the winding wires to the stator teeth 313. The frame 32 is provided with mounting lugs corresponding to the bolt hole columns 113, and the frame 32 is connected to the base shell 11 by bolts.

It is understandable that the above-mentioned specific applications are only examples of the wind shroud in this application, which can be adaptively adjusted by those skilled in the art as needed and hereby will not be elaborated in detail.

In summary, the silencing cavity in the present application is able to buffer the vibration transmitted by means of the rotation of the movable impeller, such that the noise issues of the fan may be addressed. Therefore, the wind shroud in the present application is able to effectively isolate the vibration, thereby reducing the noise of the fan and leading to the merit of the favorable vibration reduction and noise reduction. By means of fixed connection of the base shell, the bearing bracket, and the fixed impeller as an integrated part, furthermore, the components can be reduced, and a simplified installation process is effectively realized with an effect of easy installation. Furthermore, by inserting the end of the bearing unit proximal to the movable impeller into the movable impeller, the length of the rotor assembly in the axial direction is shortened, and the manufacturing cost and the weight are reduced. Further, the socket can form an interference fit and a clearance fit with the rotatable shaft, and there is an adhesive connection in the clearance fit section between the rotatable shaft and the socket. The above-mentioned installation structure can be well adapted to the working condition of the rotatable shaft with high rotation speed and brings about the advantages of simple structure and stable and reliable connection.

The embodiments described above should constitute no limitation to the scope as claimed in the application. Any equivalent modifications of structure or process according to the description and drawings in the application, or any direct or indirect applications in other related technical fields should also fall within the scope of protection as claimed in the application.

What is claimed is:

1. A wind shroud used in a fan with a movable impeller, wherein the wind shroud is integrally formed and comprises a body configured to be internally hollowed for receiving the movable impeller;

wherein the body comprises an air inlet end and an air outlet end, and the air inlet end has an inner sidewall and an outer sidewall spaced apart from each other to form a silencing cavity for buffering the vibration generated when the movable impeller is rotated, so as to reduce the noise of the fan;

wherein in a direction from the air inlet end to the air outlet end, a distance between the inner sidewall of the air inlet end and the outer sidewall of the air inlet end first gradually increases, and then gradually decreases;

wherein the inner sidewall of the air inlet end comprises a first air inlet area and a second air inlet area, and the first air inlet area is distal to the air outlet end than the second air inlet area, wherein the second air inlet area is smoothly connected to the first air inlet area and an inner sidewall of the air outlet end, respectively; and wherein the outer sidewall of the air inlet end comprises a first connection area arranged with an included angle with respect to the axis of the body, and a second connection area which is respectively connected to the first connection area and the first air inlet area and is arranged outwardly relative to the first connection area, such that the air inlet end has a trumpet-shaped tip.

2. The wind shroud according to claim 1, wherein the inner sidewall of the air inlet end comprises a first air inlet area and a second air inlet area, and the first air inlet area is distal to the air outlet end than the second air inlet area, wherein the second air inlet area is smoothly connected to the first air inlet area and an inner sidewall of the air outlet end, respectively; and wherein in the direction from the air inlet end to the air outlet end, an inner diameter of the first air inlet area is formed to gradually decrease, and an inner diameter of the second air inlet area is formed to gradually increase.

3. The wind shroud according to claim 1, wherein the first connection area is substantially in a conical shape, and the included angle is in a range of 12.5° to 22.5°.

4. The wind shroud according to claim 1, wherein in the direction from the air inlet end to the air outlet end, an inner diameter of the air outlet end is substantially formed to gradually increase;

wherein the inner sidewall of the outlet end comprises a first air outlet area and a second air outlet area, wherein the first outlet area is distal to the air inlet end than the second air outlet area, and the second air outlet area is connected to the first air outlet area and the second air inlet area, respectively; and wherein in the direction from the air inlet end to the air outlet end, an inner diameter of the first air outlet area remains unchanged, an inner diameter of the second air outlet area gradually increases, and the inner diameter of the first air outlet area is greater than the inner diameter of the second air outlet area.

5. The wind shroud according to claim 1, wherein in the direction from the air inlet end to the air outlet end, an outer diameter of an outer sidewall of the air outlet end is substantially formed to gradually increase, with a change rate gradually decreased.

6. The wind shroud according to claim 5, wherein the outer sidewall of the air outlet end comprises a third connection area and a fourth connection area, wherein the third connection area is distal to the air inlet end than the fourth connection area and is parallel to the axis of the body, and the fourth connection area is smoothly connected to the first connection area and the third connection area, respectively;

wherein an outer diameter of an outer sidewall of the fourth connection area gradually increases, and an outer diameter of an outer sidewall of the third connection area remains unchanged and is greater than the outer diameter of the outer sidewall of the fourth connection area.

7. A fan, comprising a wind shroud and a movable impeller arranged within the wind shroud, wherein the wind shroud is integrally formed and comprises a body configured to be internally hollowed for receiving the movable impeller;

wherein the body comprises an air inlet end and an air outlet end, and the air inlet end has an inner sidewall and an outer sidewall spaced apart from each other to form a silencing cavity for buffering the vibration generated when the movable impeller is rotated, so as to reduce the noise of the fan;

wherein in a direction from the air inlet end to the air outlet end, a distance between the inner sidewall of the air inlet end and the outer sidewall of the air inlet end first gradually increases, and then gradually decreases;

wherein the inner sidewall of the air inlet end comprises a first air inlet area and a second air inlet area, and the first air inlet area is distal to the air outlet end than the second air inlet area, wherein the second air inlet area is smoothly connected to the first air inlet area and an inner sidewall of the air outlet end, respectively; and wherein the outer sidewall of the air inlet end comprises a first connection area arranged with an included angle with respect to the axis of the body, and a second connection area which is respectively connected to the first connection area and the first air inlet area and is arranged outwardly relative to the first connection area, such that the air inlet end has a trumpet-shaped tip.

8. The fan according to claim 7, wherein the inner sidewall of the air inlet end comprises a first air inlet area and a second air inlet area, and the first air inlet area is distal to the air outlet end than the second air inlet area, wherein the second air inlet area is smoothly connected to the first air inlet area and an inner sidewall of the air outlet end, respectively; wherein in the direction from the air inlet end to the air outlet end, an inner diameter of the first air inlet area is formed to gradually decrease, and an inner diameter of the second air inlet area is formed to gradually increase;

wherein a projection of a first end of the movable impeller on the inner sidewall of the air inlet end is located in the first air inlet area.

9. The fan according to claim 7, wherein the first connection area is substantially in a conical shape, and the included angle is in a range of 12.5° to 22.5°.

10. The fan according to claim 8, wherein in the direction from the air inlet end to the air outlet end, an inner diameter of the air outlet end is substantially formed to gradually increase; and wherein the inner sidewall of the outlet end comprises a first air outlet area and a second air outlet area, wherein the first outlet area is distal to the air inlet end than the second air outlet area, and the second air outlet area is connected to the first air outlet area and the second air inlet area, respectively; wherein in the direction from the air inlet end to the air outlet end, an inner diameter of the first air outlet area remains unchanged, an inner diameter of the second air outlet area gradually increases, and the inner diameter of the first air outlet area is greater than the inner diameter of the second air outlet area; and wherein a projection of a second end of the movable impeller on the inner sidewall of the air inlet end is located in the second air inlet area.

11. The fan according to claim 10, wherein a projection of a second end of the movable impeller on the inner sidewall of the air outlet end is located in the second air outlet area.

12. The fan according to claim 7, wherein in the direction from the air inlet end to the air outlet end, an outer diameter of an outer sidewall of the air outlet end is substantially formed to gradually increase, with a change rate gradually decreased.

13. The fan according to claim 12, wherein the outer sidewall of the air outlet end comprises a third connection area and a fourth connection area, wherein the third connection area is distal to the air inlet end than the fourth connection area and is parallel to the axis of the body, and the fourth connection area is smoothly connected to the first connection area and the third connection area, respectively;

wherein an outer diameter of an outer sidewall of the fourth connection area gradually increases, and an outer diameter of an outer sidewall of the third connection area remains unchanged and is greater than the outer diameter of the outer sidewall of the fourth connection area.

14. The fan according to claim 7, wherein a projection of a first end of the movable impeller on the inner sidewall of the air inlet end is located in the first air inlet area.

* * * * *